US008733680B2

(12) United States Patent
Lin et al.

(10) Patent No.: US 8,733,680 B2
(45) Date of Patent: May 27, 2014

(54) SUPERSONIC PULVERIZING DEVICE

(75) Inventors: Richard Lin, Pei Tou Hsiang (TW); Chueh-Kuan Wang, Pei Tou Hsiang (TW)

(73) Assignee: GHI Fu Technology Co., Ltd., Changhua County (TW)

( * ) Notice: Subject to any disclaimer, the term of this patent is extended or adjusted under 35 U.S.C. 154(b) by 424 days.

(21) Appl. No.: 13/188,627

(22) Filed: Jul. 22, 2011

(65) Prior Publication Data

US 2013/0020421 A1 Jan. 24, 2013

(51) Int. Cl.
*B02C 19/06* (2006.01)

(52) U.S. Cl.
CPC ..... *B02C 19/06* (2013.01)
USPC ..... 241/39

(58) Field of Classification Search
CPC ..... B02C 19/06
USPC ..... 241/1, 5, 38, 39, 79, 79.1
See application file for complete search history.

(56) References Cited

U.S. PATENT DOCUMENTS

| | | | | |
|---|---|---|---|---|
| 4,354,641 | A * | 10/1982 | Smith | 241/40 |
| 4,451,005 | A * | 5/1984 | Urayama | 241/40 |
| 6,951,312 | B2 * | 10/2005 | Casalmir et al. | 241/39 |
| 2009/0159730 | A1 * | 6/2009 | Makino et al. | 241/5 |

* cited by examiner

*Primary Examiner* — Shelley Self
*Assistant Examiner* — Matthew G Katcoff
(74) *Attorney, Agent, or Firm* — Ming Chow; Sinorica, LLC

(57) ABSTRACT

A supersonic pulverizing device includes a main body which is connected with at least two charging units. Each charging unit has a charging passage therein and at least one accelerating wind nozzle disposed at a front end of the charging passage. A source material and a charging air flow are delivered to the charging passage and an accelerating air flow is inputted to the accelerating wind nozzle, so that the charging air flow carries the source material to flow and enter the main body by the accelerating air flow at a supersonic speed and counter with the charging air flow from another charging unit. The source material can be effectively crashed to the desired powder. The source material is covered by the charging air flow, so the device won't be worn by the source material. The pulverizing device has a longer lifespan and can prevent the source material from being polluted.

9 Claims, 10 Drawing Sheets

SUPERSONIC PULVERIZING DEVICE

BACKGROUND OF THE INVENTION

1. Field of the Invention

The present invention relates to a supersonic pulverizing device.

2. Description of the Prior Art

Nano powders have special optics, heat, magnetism and mechanics characters, so they are widely used to nano-coating, nano inkjet colors, bathroom equipment, photo catalyst, functional fiber textile products and edible products and the like. They have expected effects. For example, nano powders are used to bathroom equipment to get an anti-pollution effect. Nano powders are gradually popular. So far, there is a ball grinding method to produce nano powders. As shown in FIG. 1, a ball grinding machine 300 comprises a pair of rollers 301 which are turned in the same direction. A grinding cylinder 302 made of steel is disposed on the rollers 301. A plurality of grinding balls 303 (steel balls or porcelain balls) and a source material 200 are placed in the grinding cylinder 302. The rollers 301 are activated to bring the grinding cylinder 302 to turn. The grinding balls 303 and the source material 200 are attached to the inner wall of the grinding cylinder 302 due to centrifugal force and risen up along with the turning of the grinding cylinder 302. When the grinding balls 303 and the source material 200 are risen to a certain height where the gravity is larger than the centrifugal force, the grinding balls 303 and the source material 200 will free fall to transform the potential energy into kinetic energy, such that the grinding balls 300 strikes against the source material 200 and the source material 200 is crashed into powder.

However, it is not easy to control the rotational speed of the ball grinding machine 300. When the rotational speed is too high, the grinding balls 303 will tightly attach to the inner wall of the grinding cylinder 302 and won't free fall to strike against the source material 200. When the rotational speed is too low, the grinding balls 303 are unable to rise up along with the turning of the grinding cylinder 302 to get enough potential energy. In consideration of this, an air flow pulverizing technique is developed. Referring to FIG. 2, an air flow pulverizing machine 400 has a main body 401. The main body 401 has a pulverizing room 402, a plurality of air flow nozzles 403 around the pulverizing room 402, and a feeding nozzle 404. The source material 200 is sent to the pulverizing room 402 from the feeding nozzle 404, and the compressed air enters the pulverizing room 402 from the air flow nozzles 403 at a supersonic speed. The source material 200 will be crushed into powders by the injected air flow. However, the source material 200 is crushed in the pulverizing room 402 at a supersonic speed, the inner walls of the feeding nozzle 404 and the pulverizing room 402 are easily be worn by the source material 200. The air flow pulverizing machine 400 needs a cooling device to cool the heat generated by friction. Particularly, constant friction wore out the inner wall of the pulverizing room 402, and the source material 200 may be polluted by the material of the main body 401. Accordingly, the inventor of the present invention has devoted himself based on his many years of practical experiences to solve this problem.

SUMMARY OF THE INVENTION

The primary object of the present invention is to provide a supersonic pulverizing device which won't wear the device and can prevent the source material from being polluted.

In order to achieve the aforesaid object, the supersonic pulverizing device comprises a main body and at least two charging unit. The main body has a chamber therein. The main body has at least two inlets and at least one outlet at peripheral sides thereof to communicate with the chamber. The two charging unit are respectively located at the two inlets of the main body. Each charging unit has a charging passage therein. One end of the charging passage has a charging inlet and an air inlet. Another opposing end of the charging passage has a discharging outlet facing the relative inlet. Each charging unit further has an accelerating wind nozzle which is located at a front end of the discharging outlet.

According to the supersonic pulverizing device of the present invention, the source material is delivered to the charging passage and the charging air flow is inputted to the charging passage, so that the charging air flow carries the source material to the discharging outlet. After that, the accelerating air flow is inputted to the accelerating wind nozzle. The flow velocity of the accelerating air flow passing the accelerating wind nozzle is gradually increased toward the chamber to speed up the charging air flow. The air flow enters the chamber from the inlet. Because the charging units are disposed at the two opposing ends of the main body, the charging air flows from the two charging units will counter with each other and the source material along with the charging air flow will be crashed at a high speed to become powder. Thus, the source material can be effectively crashed to the desired powder. The source material is covered by the charging air flow, so the inner walls of the charging units and the chamber won't be worn by the source material. The pulverizing device has a longer lifespan and can prevent the source material from being polluted.

DETAILED DESCRIPTION OF THE PREFERRED EMBODIMENTS

Embodiments of the present invention will now be described, by way of example only, with reference to the accompanying drawings.

Figure 1:
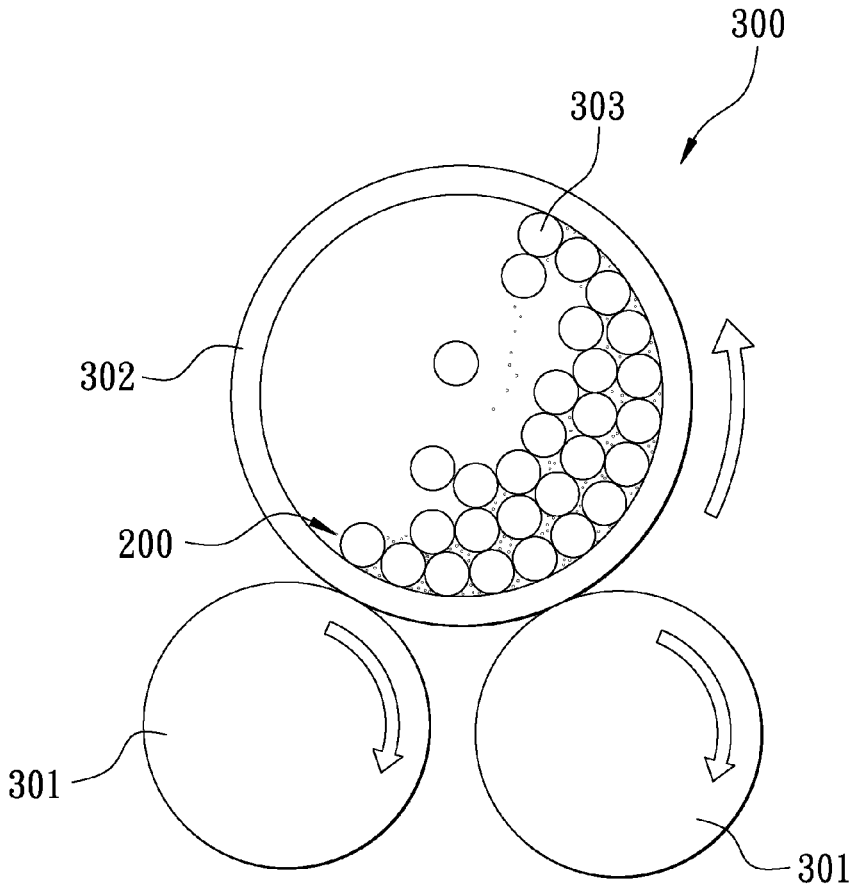
FIG. 1 PRIOR ART
FIG. 1 is a schematic view of a conventional ball grinding machine when in use.
Figure 2:
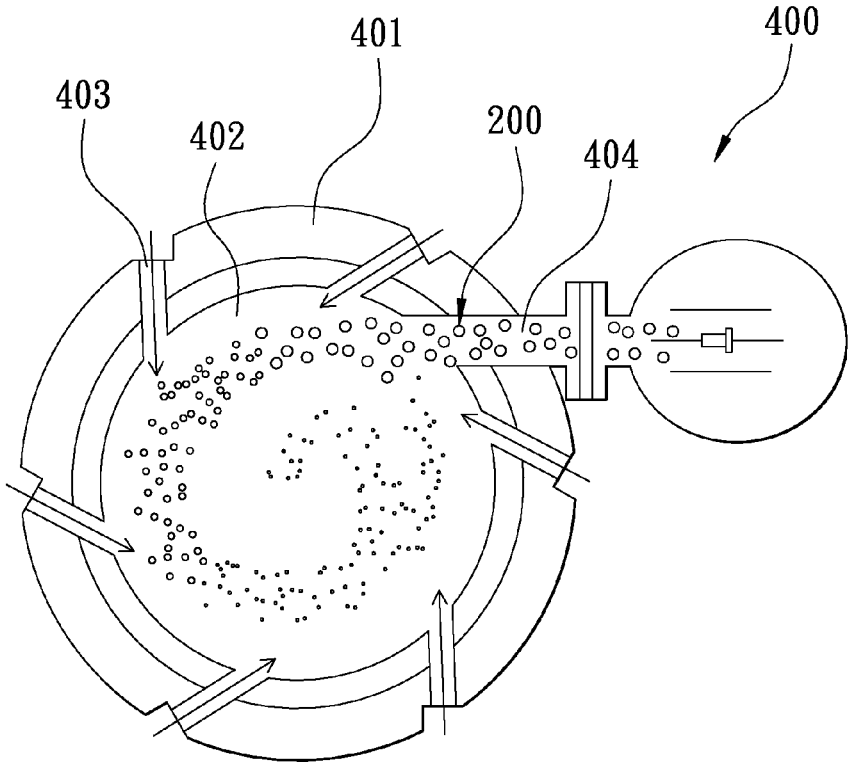
FIG. 2 PRIOR ART
FIG. 2 is a schematic view of a conventional air flow pulverizing machine when in use.
Figure 3:
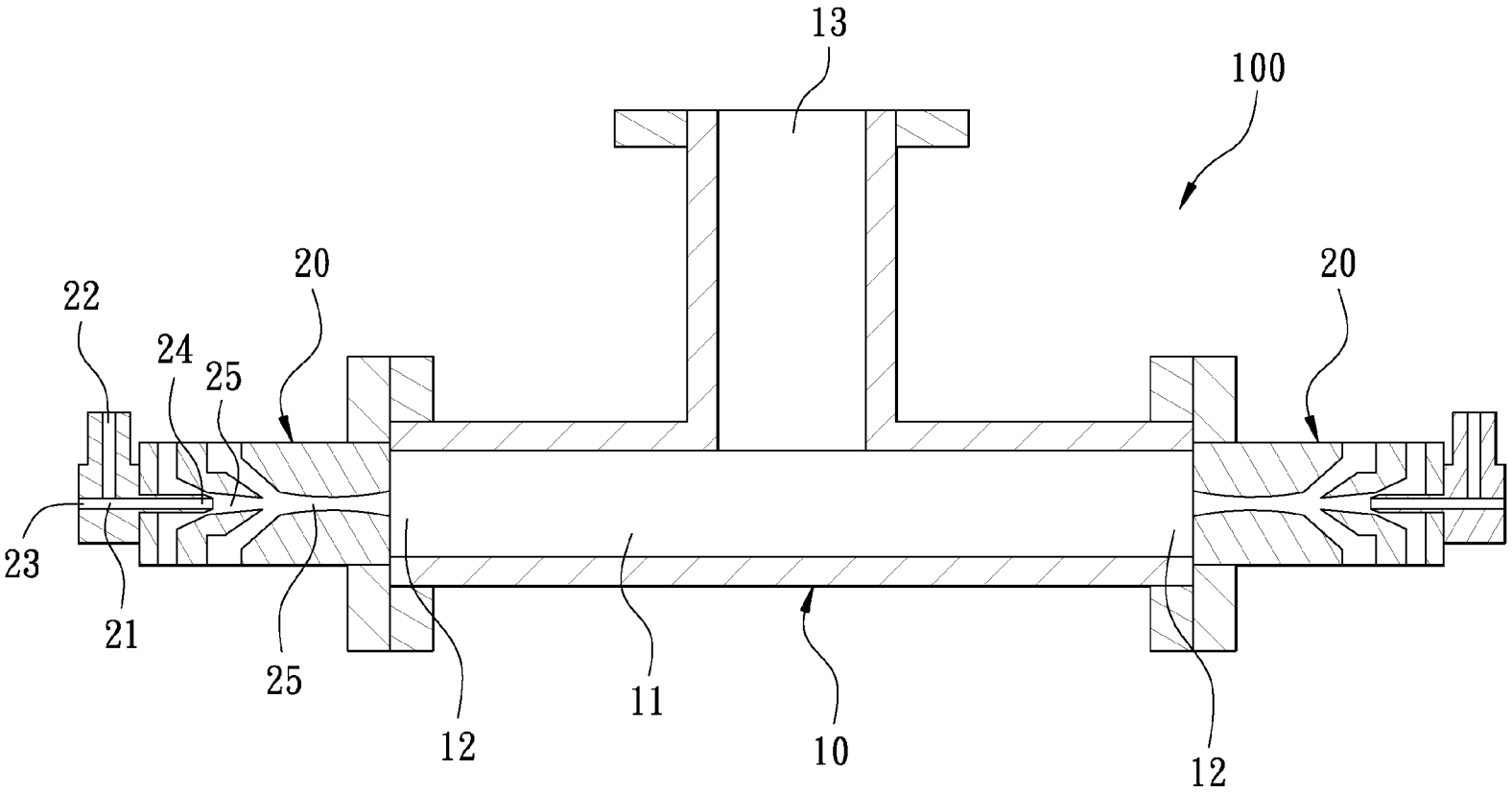
FIG. 3 is a cross-sectional view according to a first embodiment of the present invention.
Figure 4:
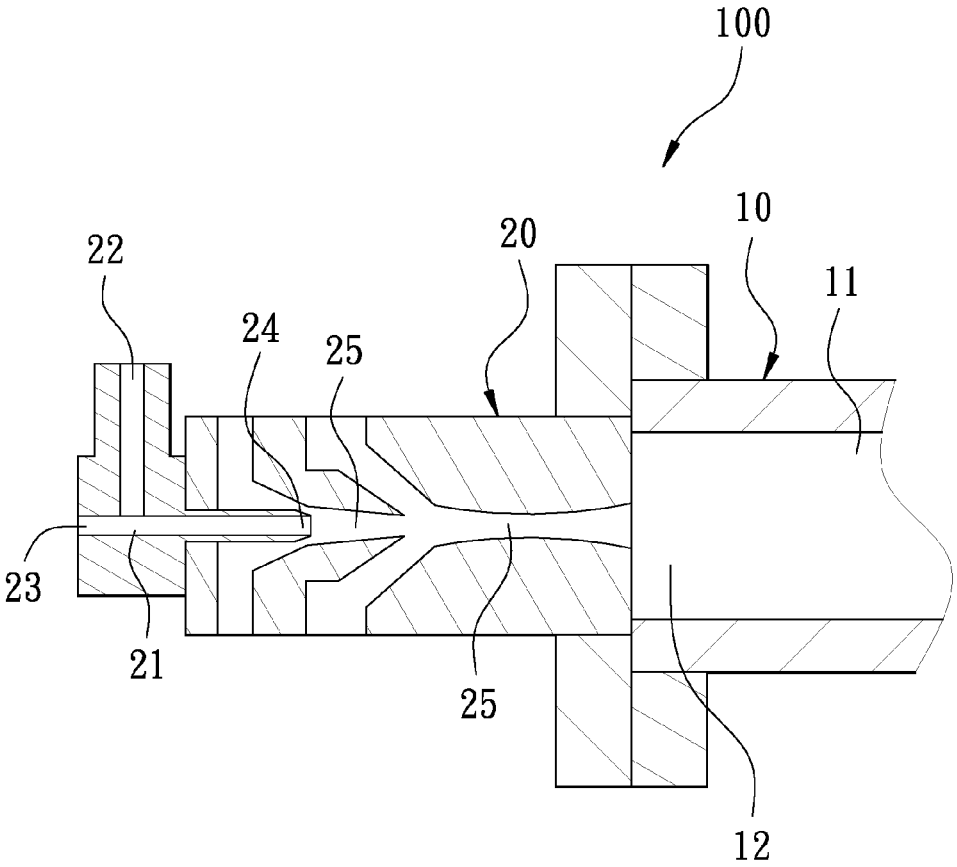
FIG. 4 is an enlarged view according to the first embodiment of the present invention.

FIG. 3 is a cross-sectional view according to a first embodiment of the present invention. FIG. 4 is an enlarged view according to the first embodiment of the present invention. The present invention relates to a supersonic pulverizing device 100. The supersonic pulverizing device 100 comprises a main body 10 and at least two charging unit 20.

The main body 10 has a chamber 11 therein. The main body 10 has at least two inlets 12 and at least one outlet 13 at peripheral sides thereof to communicate with the chamber 12. In this embodiment, the main body 10 has two inlets 12 and one outlet 13. The two inlets 12 are disposed at two opposing ends of the main body 10. The central axes of the two inlets 12 are overlapped. The outlet 13 is disposed at a side of the main body 10 and located between the two inlets 12.

The two charging unit 20 are respectively located at the inlets 12 of the main body 10. Each charging unit 20 has a charging passage 21 therein. One end of the charging passage 21 has a charging inlet 22 and an air inlet 23, and another opposing end of the charging passage 21 has a discharging outlet 24 facing the relative inlet 12. Each charging unit 20 further has an accelerating wind nozzle 25 which is located at a front end the discharging outlet 24. The accelerating wind nozzle 25 is disposed around the front end of the discharging outlet 24. The accelerating wind nozzle 25 has an inner diameter larger than that of the discharging outlet 24. In this embodiment, the supersonic pulverizing device 100 has two charging units 20. Each charging unit 20 has two accelerating wind nozzles 25 which are disposed along the central axis of the discharging outlet 24.

Figure 5:
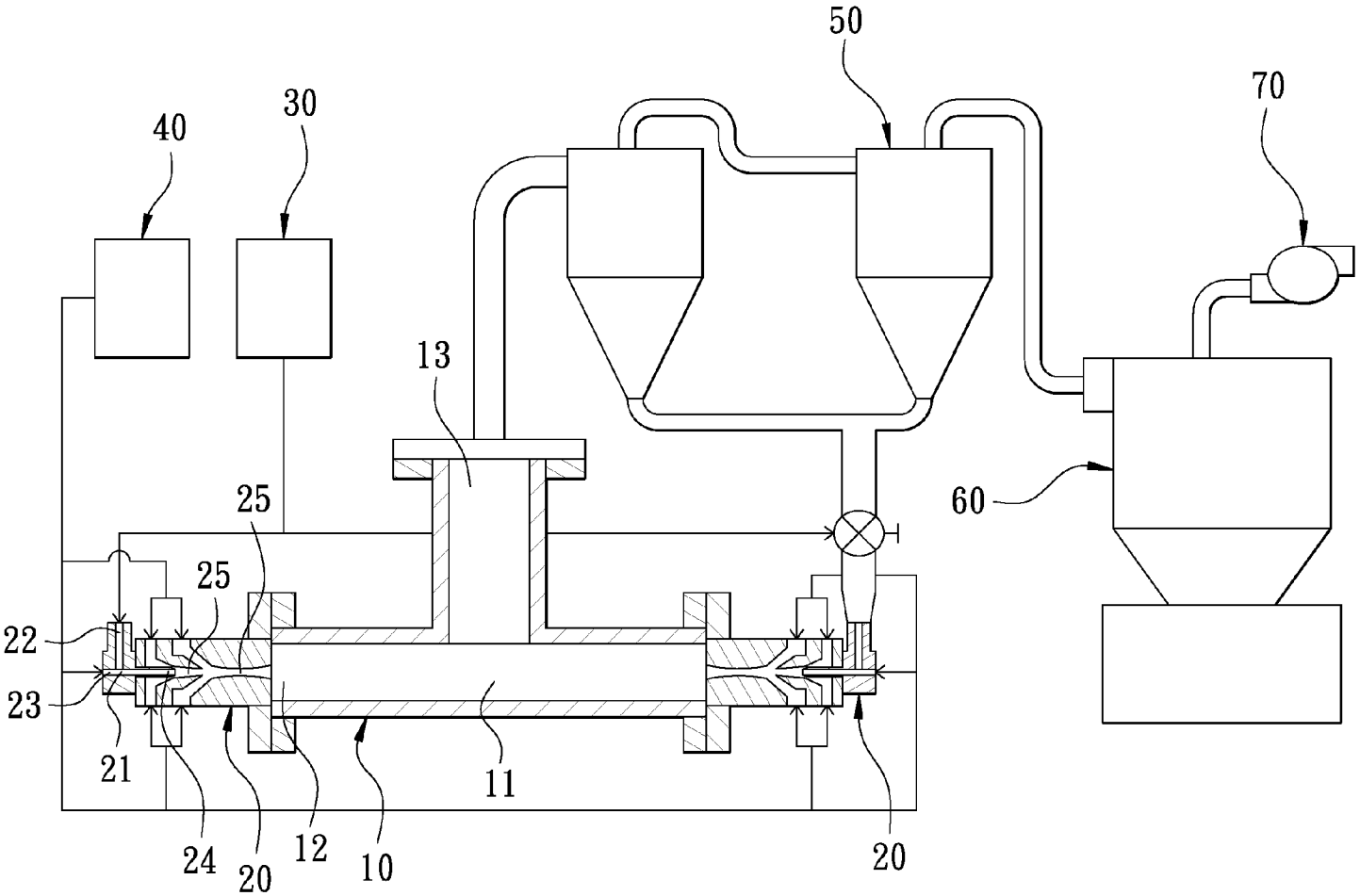
FIG. 5 is a cross-sectional view according to the first embodiment of the present invention cooperated with other apparatus.

Referring to FIG. 5, the supersonic pulverizing device 100 further comprises a feeding unit 30, an air supply unit 40, a multi-grade whirlwind separator 50, a powder collector 60, and a frequency conversion fan 70. The feeding unit 30 is connected to the charging inlet 22 of the charging unit 20 for outputting a source material 200 to the charging passage 21. The air supply unit 40 is connected to the air inlet 23 and the accelerating wind nozzle 25 for outputting a charging air flow to the air inlet 23 and an accelerating air flow to the accelerating wind nozzle 25. The multi-grade whirlwind separator 50 is connected to the outlet 13 of the main body 10 and the charging units 20 according the setting of the user to filter and grade the particle size of the source material. The powder collector 60 is connected to the multi-grade whirlwind separator 50 to collect the graded source material 200 from the multi-grade whirlwind separator 50. The frequency conversion fan 70 is connected to the powder collector 60 to vacuum the powder collector 60 according to the setting of the user, so that the outlet 13 of the main body 10 is formed with negative pressure.

Figure 6:
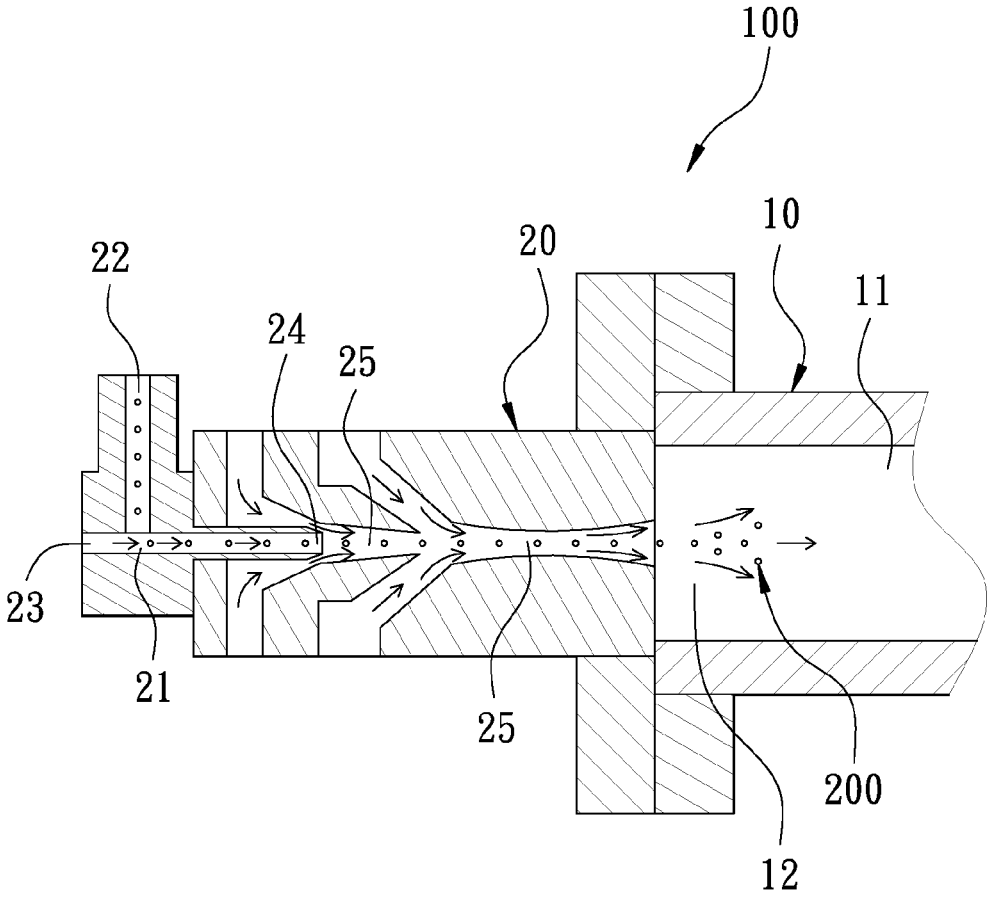
FIG. 6 is an enlarged view according to the first embodiment of the present invention when in use.
Figure 7:
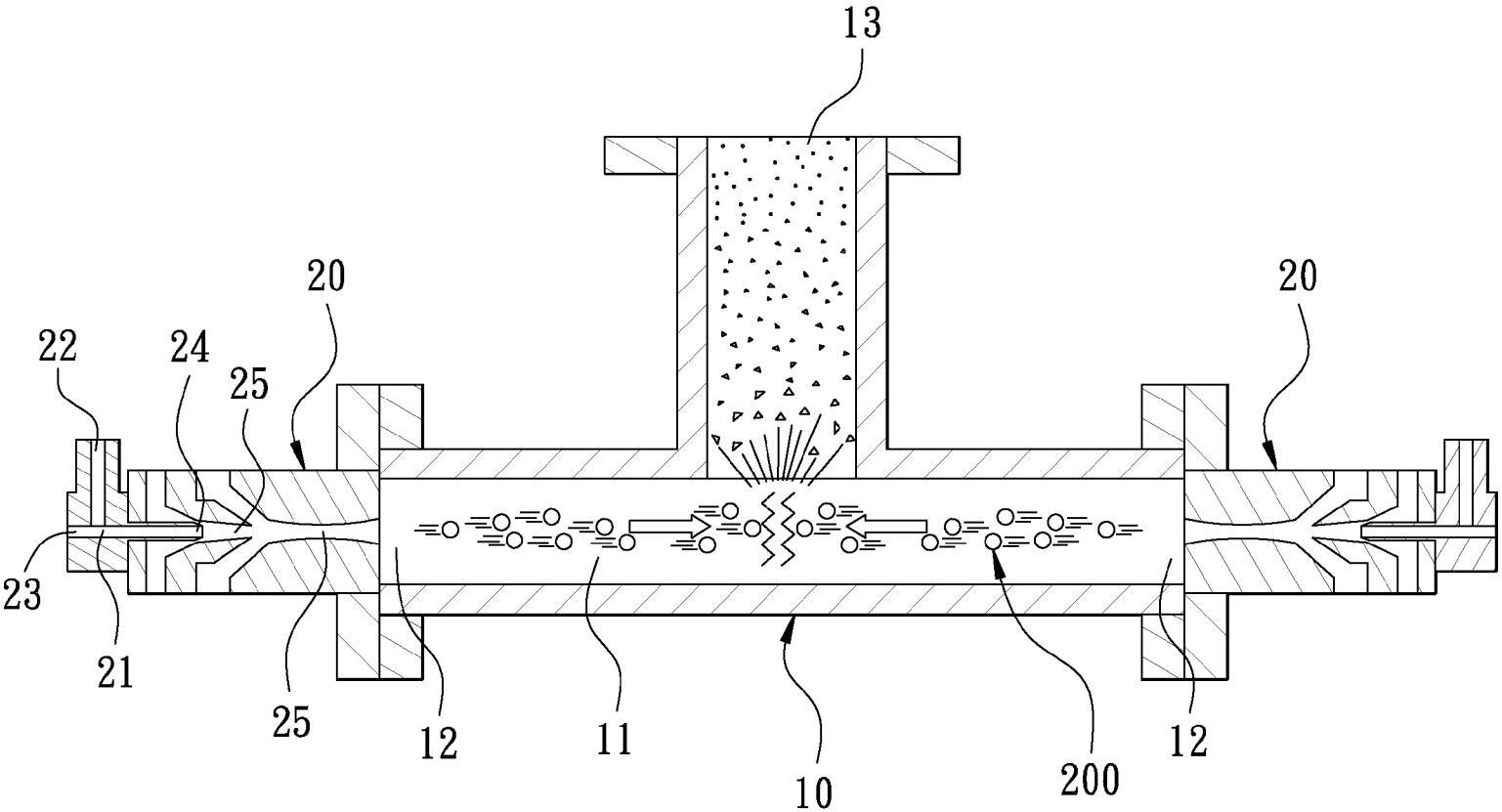
FIG. 7 is a schematic view according to the first embodiment of the present invention when in use.

Referring to FIG. 6 and FIG. 7, after the user completes the assembly of the supersonic pulverizing device 100 as shown in FIG. 5, the source material 200 from the feeding unit 30 is delivered from the charging inlet 22 to the charging passage 21. The air supply unit 40 outputs the charging air flow to slowly carry the source material 200 to the discharging outlet 24, and outputs the accelerating air flow to the accelerating wind nozzle 25. The flow velocity of the accelerating air flow passing the accelerating wind nozzle 25 is gradually increased toward the chamber 11 to speed up the charging air flow, and the flow velocity of the charging air flow is about from 300 to 400 m/s at a supersonic speed. The air flow enters the chamber 11 from the inlet 12. Because the charging units 20 are disposed at the two opposing ends of the main body 10, the charging air flows from the two charging units 20 will counter with each other and the source material 200 along with the charging air flow will be crashed at a high speed to become powders. After that, because the negative pressure is formed at the outlet 13, the powdered source material 200 is guided by the negative pressure to flow toward the outlet 13 and enter the multi-grade whirlwind separator 50 for grading. If the particle size of the source material 200 is larger than the setting, the source material 200 will be sent back to charging units 20 to be crashed again. If the particle size of the source material 200 is smaller than the setting, the source material 200 will flow to the powder collector 60 for collection. Thus, the source material 200 can be effectively crashed to the desired powders.

It is noted that the source material 200 slowly passes the charging passage 21. When the source material 200 passes the discharging outlet 24, the source material 200 will be covered by the accelerating air flow and enter the chamber 11 to be crashed at a supersonic speed because the inner diameter of the accelerating wind nozzle 25 is larger than that of the discharging outlet 24. Thus, the inner walls of the charging units 20 and the chamber 11 won't be worn by the source material 200, so that the supersonic pulverizing device has a longer lifespan and can prevent the source material 200 from being polluted.

It is noted that the source material 200 won't rub the inner walls of the charging units 20 and the chamber 11, so the temperature of the supersonic pulverizing device 100 won't rise greatly because of the heat generated by friction. When the air flow flows at a high speed, the temperature will be lowered greatly, so when the charging air flow enters the chamber 11 at a supersonic speed, the main body 10 is cooled down. Accordingly, the main body 10 doesn't need a cooling apparatus. Besides, the temperature won't rise greatly. When the source material 200, such as an edible material which is easily influenced by the temperature, is pulverized in the supersonic pulverizing device 100, the source material won't be deteriorated.

Furthermore, the particle size and weight of the source material 200 have a ratio of equality, namely, the larger size the source material 200 is, the more weight it is. The user can adjust the negative pressure at the outlet 13 of the frequency conversion fan 70 so as to control the particle size of the source material 200 attracted by the negative pressure. The small particles of the source material 200 are guided to the multi-grade whirlwind separator 50, and the large particles of the source material 200 drop into the chamber 11 to be crashed again.

Figure 8:
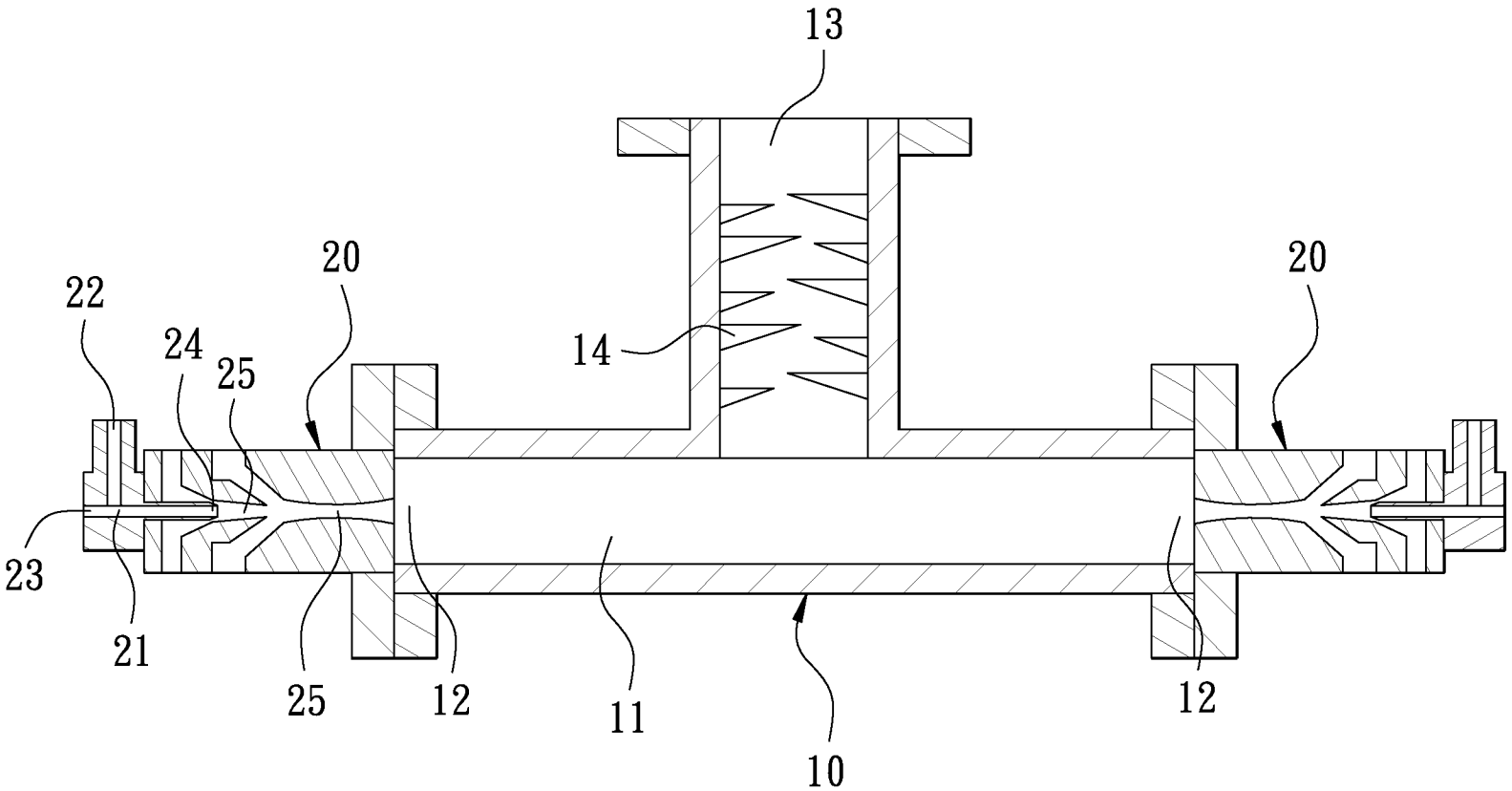
FIG. 8 is a cross-sectional view according to a second embodiment of the present invention.

FIG. 8 is a cross-sectional view according to a second embodiment of the present invention, which is substantially similar to the first embodiment with the exceptions described hereinafter. The main body 10 is provided with a plurality of separating members 14 which are transversely interlaced on the inner wall of the chamber 11. In this embodiment, the separating members 14 are blades. When the source material 200 is guided to the outlet 13 by the negative pressure, the source material 200 will be pulverized into smaller powders by the separating members 14 to enhance the pulverizing effect of the supersonic pulverizing device 100.

Figure 9:
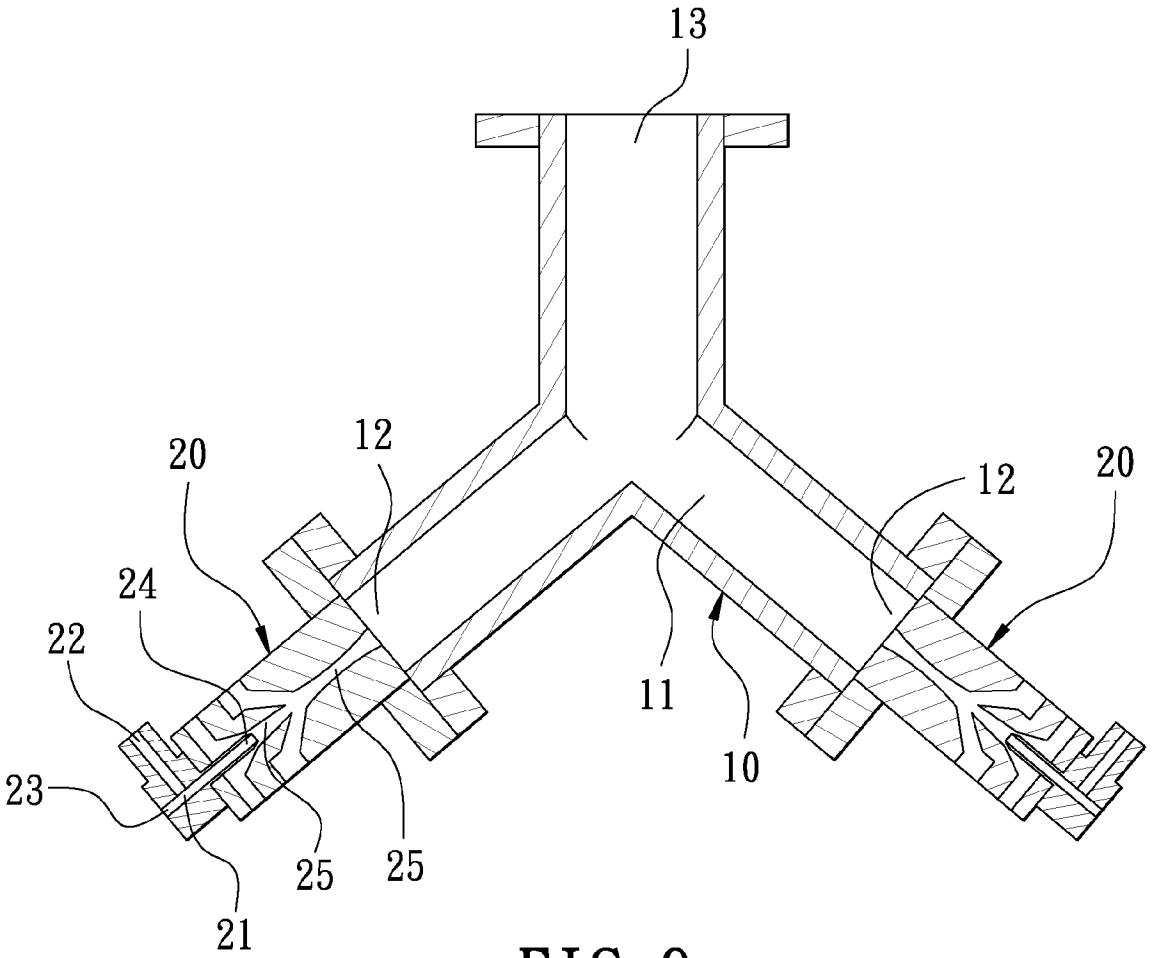
FIG. 9 is a cross-sectional view according to a third embodiment of the present invention.

FIG. 9 is a cross-sectional view according to a third embodiment of the present invention, which is substantially similar to the first embodiment with the exceptions described hereinafter. The main body 10 has two inlets 12 which are obliquely disposed with respect to the main body 10. The central axes of the two inlets 12 are interlaced in the chamber 11. When charging units 20 output the charging air flows, the charging air flows will obliquely collide with each other and the source material 200 along with the air flows will be crushed into powders to achieve the same effect of the first embodiment.

Figure 10:
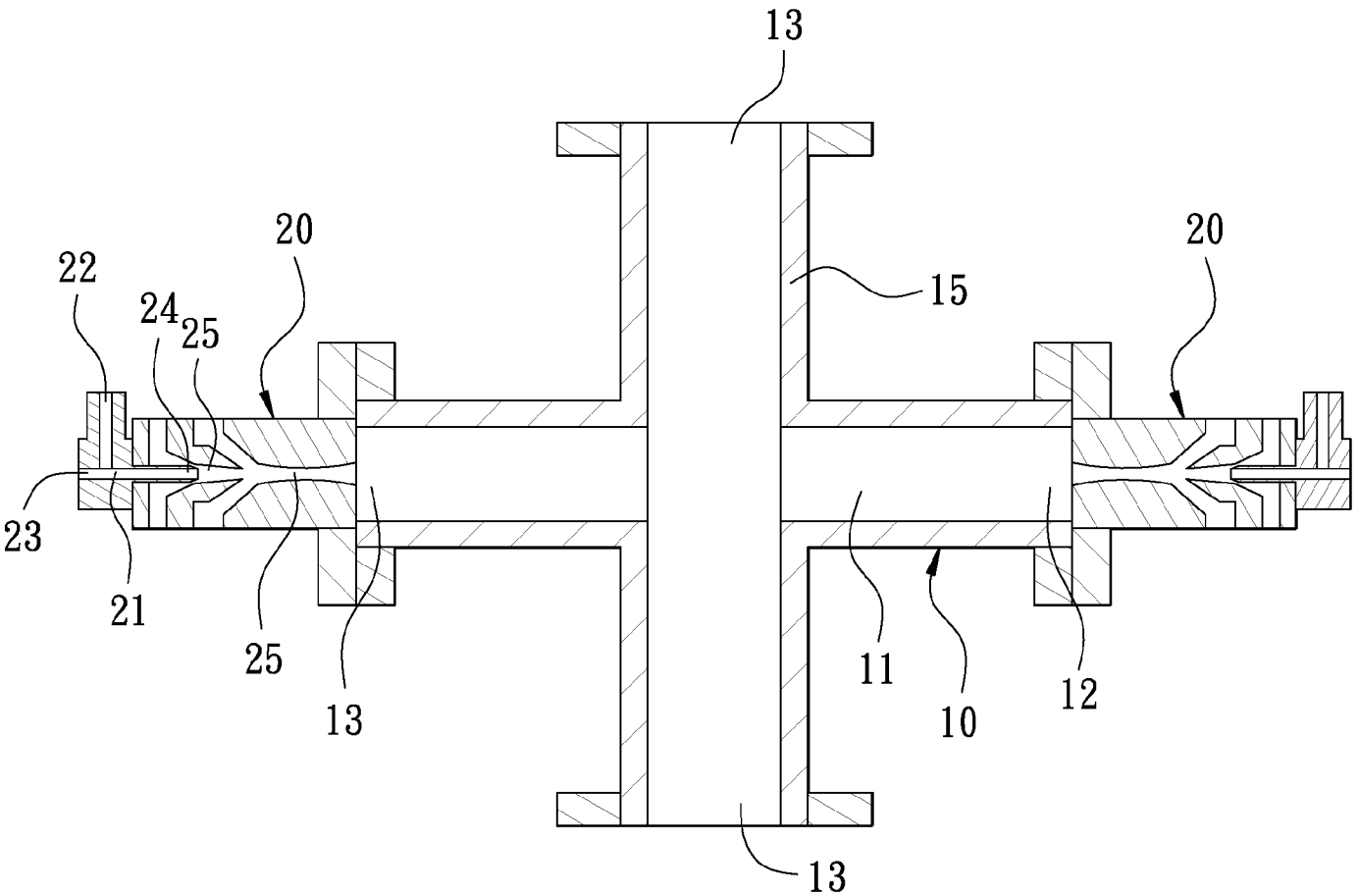
FIG. 10 is a cross-sectional view according to a fourth embodiment of the present invention.

FIG. 10 is a cross-sectional view according to a fourth embodiment of the present invention, which is substantially similar to the first embodiment with the exceptions described hereinafter. The main body 10 has an extension portion 15 extending from a peripheral side of the main body 10. The extension portion 15 has a plurality of outlets 13. When the source material 200 is crushed into powders at a high speed, the powdered source material 200 will flow to the outlets 13 from the chamber 11 to achieve the same effect of the first embodiment.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A supersonic pulverizing device, comprising:

a main body having a chamber therein, the main body having at least two inlets and at least one outlet at peripheral sides thereof to communicate with the chamber;

the main body is provided with the plurality of separating members which are transversely interlaced on an inner wall of chamber close to the at least one outlet; and two charging units respectively located at the inlets of the main body, each charging unit having a charging passage therein, one end of the charging passage having a charging inlet and an air inlet, another opposing end of the charging passage having a discharging outlet facing the relative inlet, each charging unit further having an accelerating wind nozzle which is located at a front end of the discharging outlet.

2. The supersonic pulverizing device as claimed in claim 1, wherein the two inlets are disposed at two opposing ends of the main body, and central axes of the two inlets are overlapped.

3. The supersonic pulverizing device as claimed in claim 1, wherein the two inlets are obliquely disposed with respect to the main body, and central axes of the two inlets are interlaced in the chamber.

4. The supersonic pulverizing device as claimed in claim 1, wherein the accelerating wind nozzle is disposed around the front end of the discharging outlet.

5. The supersonic pulverizing device as claimed in claim 1, wherein the accelerating wind nozzle has an inner diameter larger than that of the discharging outlet.

6. The supersonic pulverizing device as claimed in claim 1, wherein each charging unit has two accelerating wind nozzles which are disposed along a central axis of the discharging outlet.

7. The supersonic pulverizing device as claimed in claim 1, wherein the separating members are blades.

8. The supersonic pulverizing device as claimed in claim 1, wherein the negative pressure is formed at the outlet of the main body.

9. The supersonic pulverizing device as claimed in claim 1, wherein the main body has an extension portion extending from a peripheral side of the main body, and the extension portion has a plurality of outlets.

* * * * *